US010843910B2

(12) United States Patent
Osborn

(10) Patent No.: US 10,843,910 B2
(45) Date of Patent: Nov. 24, 2020

(54) ELECTRIC POWERED PNEUMATIC BALANCER

(71) Applicant: Ingersoll-Rand Industrial U.S., Inc., Davidson, NC (US)

(72) Inventor: Wayne E. Osborn, Kent, WA (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 418 days.

(21) Appl. No.: 15/703,049

(22) Filed: Sep. 13, 2017

(65) Prior Publication Data

US 2019/0077640 A1 Mar. 14, 2019

(51) Int. Cl.

| | |
|---|---|
| ***B66D 1/08*** | (2006.01) |
| ***B66C 11/00*** | (2006.01) |
| ***B66D 1/44*** | (2006.01) |
| ***F15B 11/10*** | (2006.01) |

(52) U.S. Cl.

CPC ..... *B66D 1/08* (2013.01); *B66C 11/00* (2013.01); *B66D 1/44* (2013.01); *F15B 11/10* (2013.01)

(58) Field of Classification Search

CPC .. B66D 1/08; B66D 1/44; B66C 11/00; F15B 1/027; F15B 11/064; F15B 11/10

See application file for complete search history.

(56) References Cited

U.S. PATENT DOCUMENTS

| | | | | |
|---|---|---|---|---|
| 3,125,200 | A * | 3/1964 | Kaman | B66D 3/22 477/182 |
| 3,286,989 | A | 11/1966 | Bangerter et al. | |
| 3,325,148 | A | 6/1967 | Powell | |
| 3,384,350 | A | 5/1968 | Powell | |
| 3,635,442 | A | 1/1972 | Ulbing | |
| 3,675,899 | A | 7/1972 | McKendrick | |
| 3,791,627 | A | 2/1974 | Stone et al. | |
| 4,643,018 | A | 2/1987 | Wünsch | |
| 5,370,367 | A | 12/1994 | Zaguroli, Jr. | |
| 5,522,581 | A | 6/1996 | Kulhavy | |
| 5,611,522 | A | 3/1997 | Zaguroli, Jr. | |
| 5,848,781 | A | 12/1998 | Kulhavy et al. | |
| 5,984,276 | A | 11/1999 | Green | |

(Continued)

FOREIGN PATENT DOCUMENTS

| | | |
|---|---|---|
| KR | 19990068437 | 9/1999 |
| KR | 1020040026313 A | 3/2004 |

OTHER PUBLICATIONS

PCT International Search Report dated Jan. 17, 2019, Application PCT/US18/50747, Filed Sep. 12, 2018.

(Continued)

*Primary Examiner* — Sang K Kim
*Assistant Examiner* — Nathaniel L Adams
(74) *Attorney, Agent, or Firm* — Taft Stettinius & Hollister LLP

(57) ABSTRACT

An electric powered pneumatic balancer is provided. In an embodiment it includes: a housing; an air balancer located in the housing; and a compressor located in the housing. The housing includes an opening to receive air to the compressor as it generates compressed air. The compressor is in fluid communication with the balancer which operates in response to receipt of the pressurized air from the compressor. An electrical power supply is in electrical communication with the compressor to power the compressor to generate the pressurized air.

20 Claims, 7 Drawing Sheets

(56) References Cited

U.S. PATENT DOCUMENTS

| | | | | |
|---|---|---|---|---|
| 6,547,220 | B2 | 4/2003 | Johnson | |
| 6,695,292 | B2 | 2/2004 | Nam | |
| 7,097,156 | B2 | 8/2006 | Nam | |
| 7,134,644 | B2 | 11/2006 | Wallner | |
| 8,317,161 | B2 | 11/2012 | Fujii | |
| 2010/0108965 | A1 | 6/2010 | Fujii | |
| 2014/0061558 | A1* | 3/2014 | Einhorn | B66D 1/39 254/331 |

OTHER PUBLICATIONS

Ingersoll Rand; Ergonomic Handling Systems, 2013.
Ingersoll Rand; Product Parts Information Air Balancers Series ZA, EA and BA, 2011.

* cited by examiner

ELECTRIC POWERED PNEUMATIC BALANCER

TECHNICAL FIELD AND SUMMARY

The present disclosure relates, generally, balancers and, more particularly, to an electric powered pneumatic balancer.

Pneumatic power balancers are known to assist a person in lifting objects that are often too heavy to lift alone. Manufacturing environments, particularly assembly lines, such as an automobile manufacturing plant are locations where heavy objects typically need to be carried, moved, and installed—often by persons. In these environments air balancers may be used to help lift and support the weight of the objects. And because conventional air balancers may be mounted on rails or other like structures, they are conveniently movable from one location to another. This means a person may have the balancer lift the heavy object at one location and move it to a second location as part of a manufacturing process. In some instances, it is not possible for the person to lift certain objects such as an engine or car door on a repetitive basis. This makes such lift assist mechanisms critical. These balancers, therefore, expand the capabilities of the person as well as the type of person who can perform the job because not so much heavy lifting is involved.

An air powered balancer employs a cable or chain that can move up and down while supporting the weight of an attached object. A typical balancer includes a cable wrapped around a rotating drum. That drum is attached to a rotating ball screw which rotates to wind and unwind the cable. A linearly movable piston is coupled to the ball screw such that as the piston moves linearly in one direction it causes the ball screw to rotate in one direction. When the piston moves linearly in the opposite direction it causes the ball screw to likewise rotate in an opposite direction. In other words, when air is applied to the piston it linearly pushes the ball screw to wind-up or retract the cable on the drum, thereby lifting any object attached to the cable. When air is released and is no longer pushing against the piston, it moves linearly in the opposite direction causing the ball screw to rotate in an opposite direction to unwind the cable thereby lowering the attached object.

Examples of such air balancers are disclosed in U.S. Pat. No. 3,384,350, titled "Pneumatically-operated device for manipulating heavy loads", issued May 21, 1968, U.S. Pat. No. 5,522,581 titled "Balancing hoist and material handling system", issued Jun. 4, 1996, U.S. Pat. No. 5,848,781, titled "Balancing hoist braking system", issued Dec. 15, 1998, U.S. Pat. No. 8,317,161, titled "Air balancer", issued Nov. 27, 2012, U.S. Pat. No. 7,097,156, titled "Safety device of air balancing hoist", issued Aug. 29, 2006, U.S. Pat. No. 7,134,644, titled "Compressed air balancer", issued Nov. 14, 2006, U.S. Pat. No. 6,695,292, titled "Safety device for air balancing hoist", issued Feb. 24, 2004, U.S. Pat. No. 6,547,220 titled "Open loop control with velocity threshold for pneumatic hoist", issued Apr. 14, 2003, U.S. Pat. No. 3,791,627, titled "Pneumatically-operated hoist with automatic control system", issued Feb. 12, 1974, U.S. Pat. No. 4,643,018, titled "Rectangular box-like housing for a bending machine", issued Feb. 17, 1987, U.S. Pat. No. 5,984,276, titled "Cable retraction speed limiter for air balancing hoist", issued Nov. 16, 1999, U.S. Pat. No. 5,370,367, titled "Safety device for an air balancing hoist", issued Dec. 6, 1994, U.S. Pat. No. 5,522,581, titled "Balancing hoist and material handling system", issued Jun. 4, 1996, U.S. Pat. No. 3,635, 442, titled "Air balancer safety system", issued Jan. 18, 1972, and U.S. Pat. No. 3,675,899, titled "Hoist and balancing apparatus", issued Jul. 11, 1972, the disclosures of which are incorporated herein by reference in their entireties.

To make an air balancer work, however, there needs to be an independent source of pressurized air. Without that pressurized air, the piston and drum in the air balancer have no ability to move. In manufacturing environments such as the assembly line, sources of pressurized air are commonplace. But other environments where such lift assistance may be useful often have no such source of pressurized air available. Office settings including resource centers where large boxes of paper and materials are moved all of the time and could benefit from a lift assist. Likewise, cargo or delivery vehicles transporting heavy packages may benefit from a lift assist as well. Neither of these environments, as well as many others, have a pressurized air source available to operate an air balancer. But what they all do have is an electrical power source such as 110 volt or 220 volt power outlets.

Accordingly, an illustrative embodiment of the present disclosure provides an electric powered pneumatic balancer that may be employed at locations where no pressurized air is available. In an illustrative embodiment, an onboard electrically powered compressor may be used to supply the pressurized air needed to operate the balancer. In a further embodiment, the electric powered pneumatic balancer may include onboard air chambers usable for storing pressurized air to feed into the balancer. Illustratively, the compressor may be plugged into a conventional power source such as a wall socket, or may be battery operated.

Another illustrative embodiment of the present disclosure provides an electric powered pneumatic balancer that comprises: a housing that includes a first cavity, a second cavity spaced apart from the first cavity, and a third cavity spaced apart from the first and second cavities; an air balancer located in the first cavity of the housing; a compressor located in the second cavity of the housing; wherein the housing includes an opening to receive air to the compressor; wherein the third cavity is in fluid communication with the compressor in the second cavity and stores pressurized air produced by the compressor; a first supply tube in fluid communication with the third cavity; a controller fluidly coupled to the first supply tube to receive the pressurized air from the third cavity; a second supply tube that is in fluid communication with the controller and the air balancer; wherein the air balancer operates in response to the pressurized fluid that moves from the compressor and the third cavity, through the first supply tube, controller, and second supply tube; and an electrical power supply in electrical communication with the compressor to power the compressor to generate the pressurized air.

In the above and other illustrative embodiments, the electric powered pneumatic balancer may further comprise: the air balancer only receiving compressed air from the compressor and does not receive compressed air from a source separate from the electric powered pneumatic balancer; the housing further including fourth and fifth cavities that are spaced apart from each other and the first, second, and third cavities, but are in fluid communication with each other and the first, second, and third cavities; the housing being open on each of its first and second ends; a first end cap that covers the first end of the housing, and wherein a first passageway is disposed within the first end cap in fluid communication with at least the third cavity of the housing and the first supply tube; a first end cap that covers the first end of the housing, and wherein a first passageway is disposed within the first end cap in fluid communication with at least the compressor and the first supply tube; the housing further includes fourth and fifth cavities that are spaced apart from each other and the first, second, and third cavities, but are in fluid communication with each other and the first, second, and third cavities, wherein the housing is open on each of its first and second ends, wherein the electric powered pneumatic balancer includes a first end cap that covers the first end of the housing, and wherein a first passageway is disposed within the first end cap in fluid communication with the third, fourth, and fifth cavities and the first supply tube; the first endcap including a plurality of seals, wherein each of the plurality of seals seal the first, second, and third cavities, respectively; an electrical cord that supplies electric power to the compressor; a battery that supplies electric power to the compressor.

Another illustrative embodiment of the present disclosure provides an electric powered pneumatic balancer that comprises: a housing that includes a first cavity; an air balancer located in the housing and spaced apart from the first cavity of the housing; a compressor located in the housing and spaced apart from the first cavity of the housing; wherein the housing includes an opening to receive air to the compressor; wherein the compressor generates compressed air; wherein the first cavity is in fluid communication with the compressor in the housing and stores pressurized air; wherein the air balancer operates in response to receipt of the pressurized air that moves from the compressor in the housing and the first cavity; and an electrical power supply in electrical communication with the compressor to power the compressor to generate the pressurized air.

In the above and other illustrative embodiments, the electric powered pneumatic balancer may further comprise: a first supply tube in fluid communication with the first cavity, a controller fluidly coupled to the first supply tube to receive the pressurized air from the first cavity, a second supply tube being in fluid communication with the controller and the air balancer; and through the first supply tube, controller, and second supply tube compressed air is selectively supplied to the air balancer; the air balancer only receiving compressed air from the compressor and does not receive compressed air from a source separate from the electric powered pneumatic balancer; the housing is open on each of its first and second ends, includes a first end cap that covers the first end of the housing, and wherein a first passageway is disposed within the first end cap in fluid communication with at least the first cavity of the housing and the first supply tube; the first endcap includes a seal, wherein the seal seals the housing and the first cavity; an electrical cord that supplies electric power to the compressor; and a battery that supplies electric power to the compressor.

Another illustrative embodiment of the present disclosure provides an electric powered pneumatic balancer that comprises: a housing; an air balancer located in the housing; a compressor located in the housing; wherein the housing includes an opening to receive air to the compressor; wherein the compressor generates compressed air; wherein the compressor is in fluid communication with the balancer; wherein the air balancer operates in response to receipt of the pressurized air from the compressor; and an electrical power supply that is in electrical communication with the compressor to power the compressor to generate the pressurized air.

In the above and other illustrative embodiments, the electric powered pneumatic balancer may further comprise: the housing including a cavity that stores pressurized air to deliver to the air balancer; and the air balancer only receiving compressed air from the compressor and does not receive compressed air from a source separate from the electric powered pneumatic balancer.

Additional features and advantages of the electric powered pneumatic balancer will become apparent to those skilled in the art upon consideration of the following detailed description of the illustrated embodiments exemplifying best modes of carrying out the electric powered pneumatic balancer as presently perceived.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity.

Figure 1:
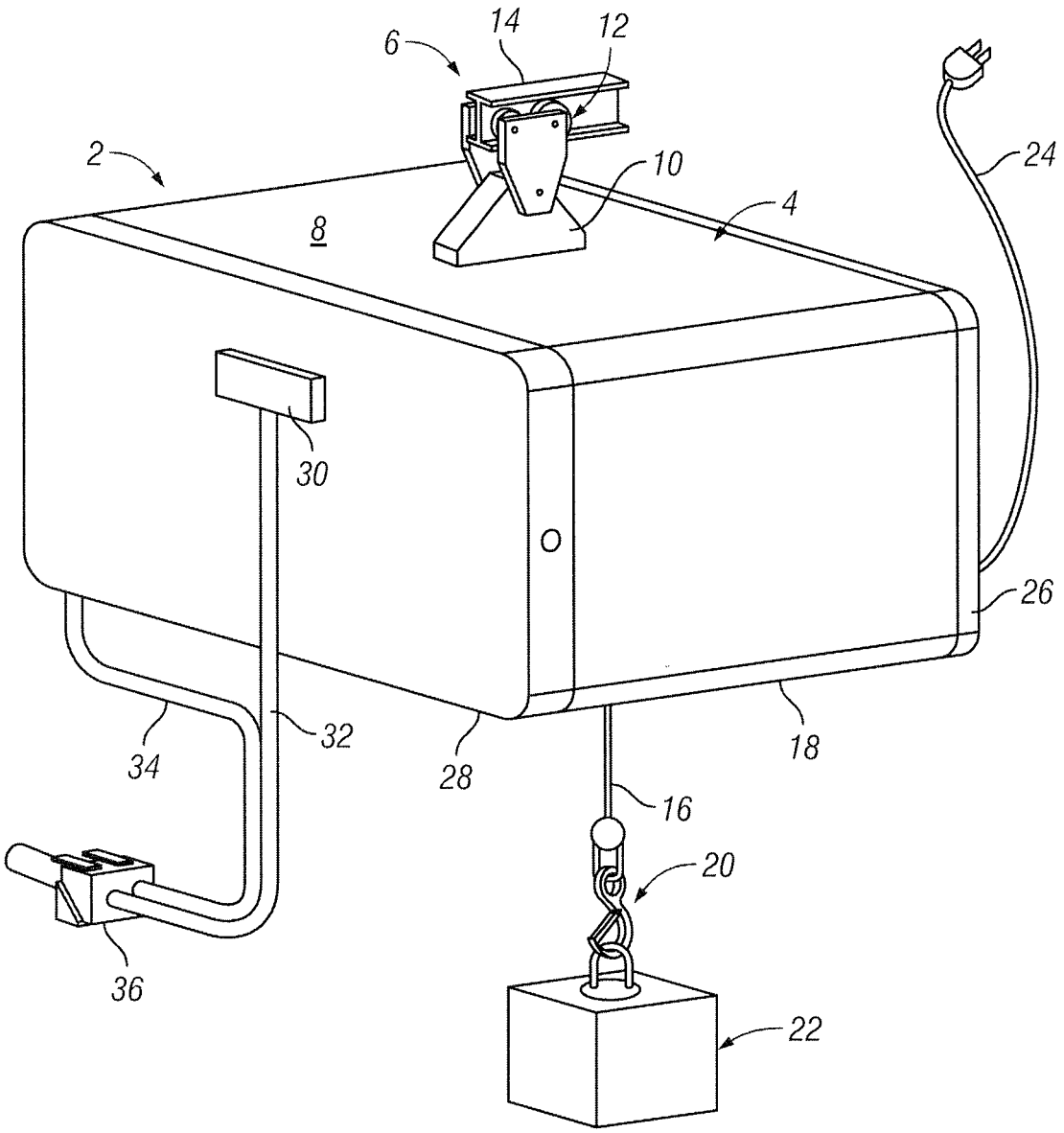
FIG. 1 is a perspective view of an illustrative embodiment of an electric powered pneumatic balancer.

Corresponding reference characters indicate corresponding parts throughout the several views. The exemplification set out herein illustrates embodiments of the electric powered pneumatic balancer, and such exemplification is not to be construed as limiting the scope of the electric powered pneumatic balancer in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention.

An illustrative embodiment of the present disclosure provides an electric powered pneumatic balancer 2. A perspective view of such an illustrative electric powered pneumatic balancer 2 is shown in FIG. 1. Balancer 2 includes a housing 4 configured to be suspended via a bracket system, such as the illustrative I-beam roller bracket system 6 shown located on topside 8 of housing 4. In this illustrative embodiment, I-beam roller bracket systems 6 includes a bracket 10 illustratively attached to topside 8. Bracket 10 is connected to rollers 12 that engage an I-beam 14. Illustratively, I-beam 14 may be longitudinally extending to allow electric powered pneumatic balancer 2 to move lineally to different locations along I-beam 14. This will make electric powered pneumatic balancer 2 accessible to different locations within a given area. It is appreciated, however, that other attachment systems and means may be employed to hold and/or suspend electric powered pneumatic balancer 2. As a skilled artisan will appreciate, a variety of hooks, brackets, fasteners, etc. exist in the art that may be configured to hold pneumatically powered balancers. Such attachment mechanisms may be used with electric powered pneumatic balancer 2 as well.

Illustratively, opposite bracket system 6 is cable 16 extending from underside 18 of housing 4. A latch mechanism 20 is attached to the end of cable 16 and is configured to hold a weighted object 22. It is appreciated that weighted object 22 illustratively represents any myriad of structures that can be carried by such balancers. Typically, such structures are too heavy to be constantly carried without assistance of some mechanical means. The skilled artisan upon reading this disclosure will appreciate that such objects configured to be carried by pneumatic balancers may be carried by the electric power pneumatic balancer of the present disclosure as well. To that end, latch 20 is also simply illustrative of the variety of attaching means that can hold weighted object 22. Again, the skilled artisan, upon reading this disclosure, will appreciate that any type of clamps, supports, or other like structures that are typically used on air balancers may be attached to cable 16 and employed for use with electric powered pneumatic balancer 2 of the present disclosure as well.

A distinction between electric powered pneumatic balancer 2 shown herein, and a prior art air balancer (as demonstrated in PRIOR ART FIG. 8), is that no separate pressurized air source is needed to operate electric powered pneumatic balancer 2 despite it being an air powered balancer. Electric powered pneumatic balancer 2 has its own pressurized air generation and storage system that only requires electricity in order to operate (see, also, FIG. 3). As such, except for needing only electric power to operate an air pump, electric powered pneumatic balancer 2 may operate similar to known air balancer mechanisms (such as those disclosed in the U.S. patents identified above which are incorporated herein by reference). In the present disclosure, however, all that is needed is either a power outlet which is readily available in most buildings, or wired access to another electrical power source such as a battery. No external pressurized air source is required. A battery source may be used if electric powered pneumatic balancer 2 is installed in a vehicle, such as the cargo area of a delivery or cargo truck. In other words, electric power is generally available almost everywhere, whereas pressurized pneumatic power is not. This makes the functionality and potential application of electric power pneumatic balancer 2 more expansive than conventional prior art air balancers.

Electric powered pneumatic balancer 2 only needs to be installed and plugged-in to operate. Again, no external pressurized air source is required. To that end, extending from housing 4 is power cord 24. The character and type of cord and plug shown herein, are illustrative only. It is appreciated that the power needs of the compressor will dictate the specific character and type of power cord 24 and plug used. That said, the skilled artisan will understand upon reading this disclosure what power requirements will be needed for any particular compressor that may be used in electric power pneumatic balancer 2 to make it operate. Furthermore, although power cord 24 is shown extending from end cap 26, it is appreciated that power cord 24 may extend from any convenient location on electric powered pneumatic balancer 2.

Extending from the other end cap 28 is a controls manifold 30 that receives supply tube 32. Another supply tube 34 extends illustratively from the base of end cap 28. The utility of supply tubes 32 and 34 will be further described herein. Nonetheless, the particular locations of controls manifold 30, as well as supply tubes 32 and 34 on electric powered pneumatic balancer, are illustrative. It will be appreciated by the skilled artisan upon reading this disclosure that the positioning of the structures may be moved to other locations as needed. That said, other locations may be included within the scope of this disclosure. In the illustrative embodiment, supply tube 34 is configured to receive pressurized air from the onboard compressor (see, also, FIG. 3) and be delivered to controller 36. Illustratively, controller 36 will determine whether air will be sent to or released from the air balancer mechanism in housing 4. To that end, the pressurized air in supply tube 34 may be transferred to supply tube 32 through controller 36 and delivered to the air balancer mechanism via controls manifold 30. High pressure air from the storage tanks goes to the controller, 36. When the operator presses one button on the controller, the operator is allowing high pressure to enter balancer 2 via the controls manifold 30 to lift the load. When the operator presses the other button, air is vented from the balancer to lower the load. Supply tube 34 will always be at the same pressure as the compressed air in the storage tanks. Supply tube 32 will be at the same pressure as the air inside the balancer bore.

Figure 2:
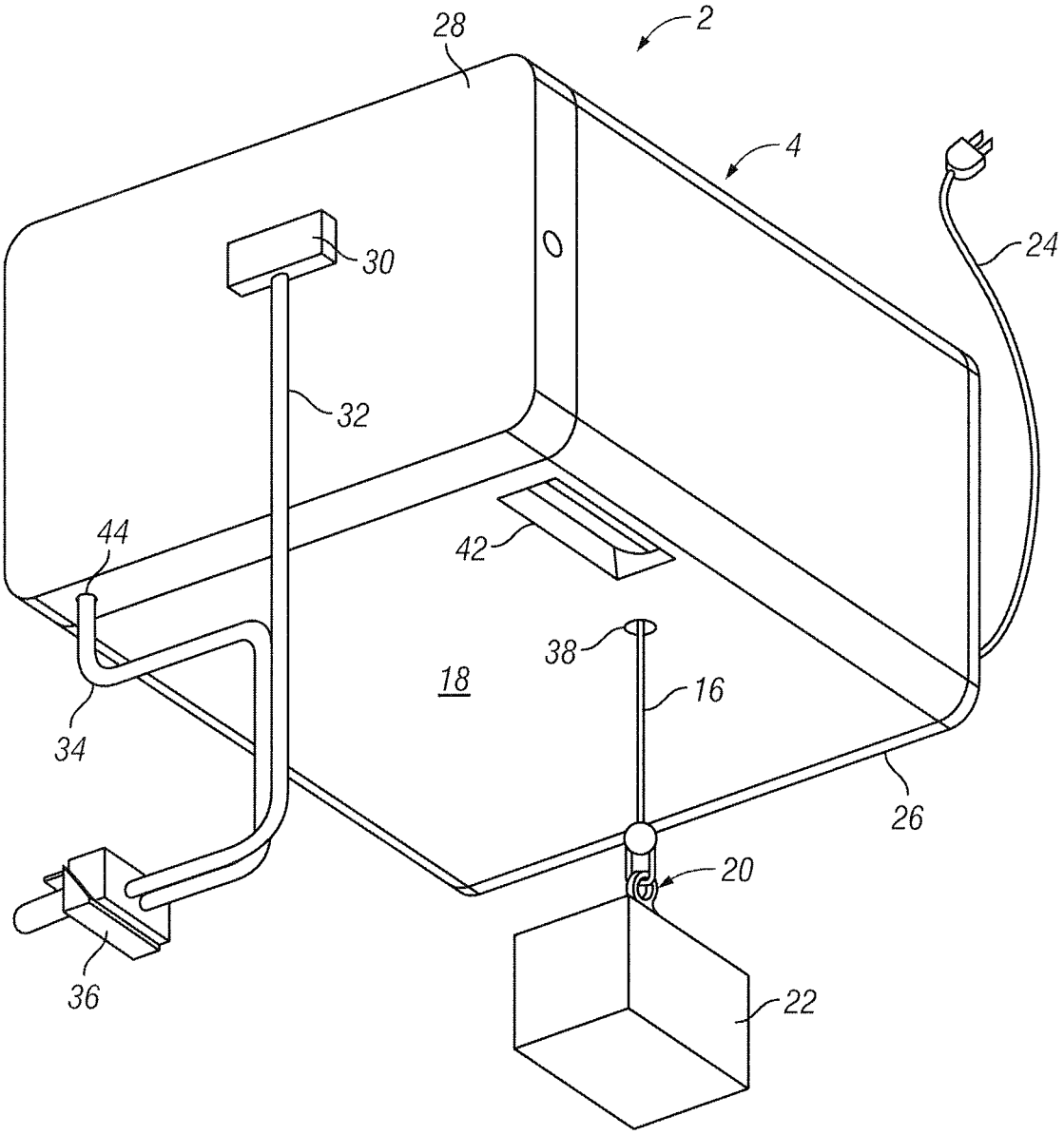
FIG. 2 is an underside perspective view of the electric powered pneumatic balancer of FIG. 1.

An underside perspective view of electric powered pneumatic balancer 2 is shown in FIG. 2. This view further shows structures previously discussed with respect to FIG. 1. For example, cable 16 with latch assembly 20 holding weighted object 22 is depicted extending through opening 38 on underside 18 of housing 4. Also shown in this view is air intake port 42 that is illustratively located in proximity of the air compressor (see, also, FIG. 3) which allows air to be drawn up into housing 4 and be pressurized by the compressor. It is appreciated that such an air port may be located anywhere needed on electric powered pneumatic balancer assembly 2 in order to draw in the air that feeds the compressor. Controls manifold 30 was also shown on end cap 28 with supply tube 32 extending therefrom to controller 36. Supply tube 34, on the other hand, extends from air port 44. Supply tube 34 is receiving compressed air that is generated by the compressor. Lastly, power cord 24 is illustratively shown extending from end cap 26. Again, power cord 24 may extend from any suitable location on electric powered pneumatic balancer 2 in order to connect with a power outlet to supply electric power to electric powered pneumatic balance 2.

Figure 3:
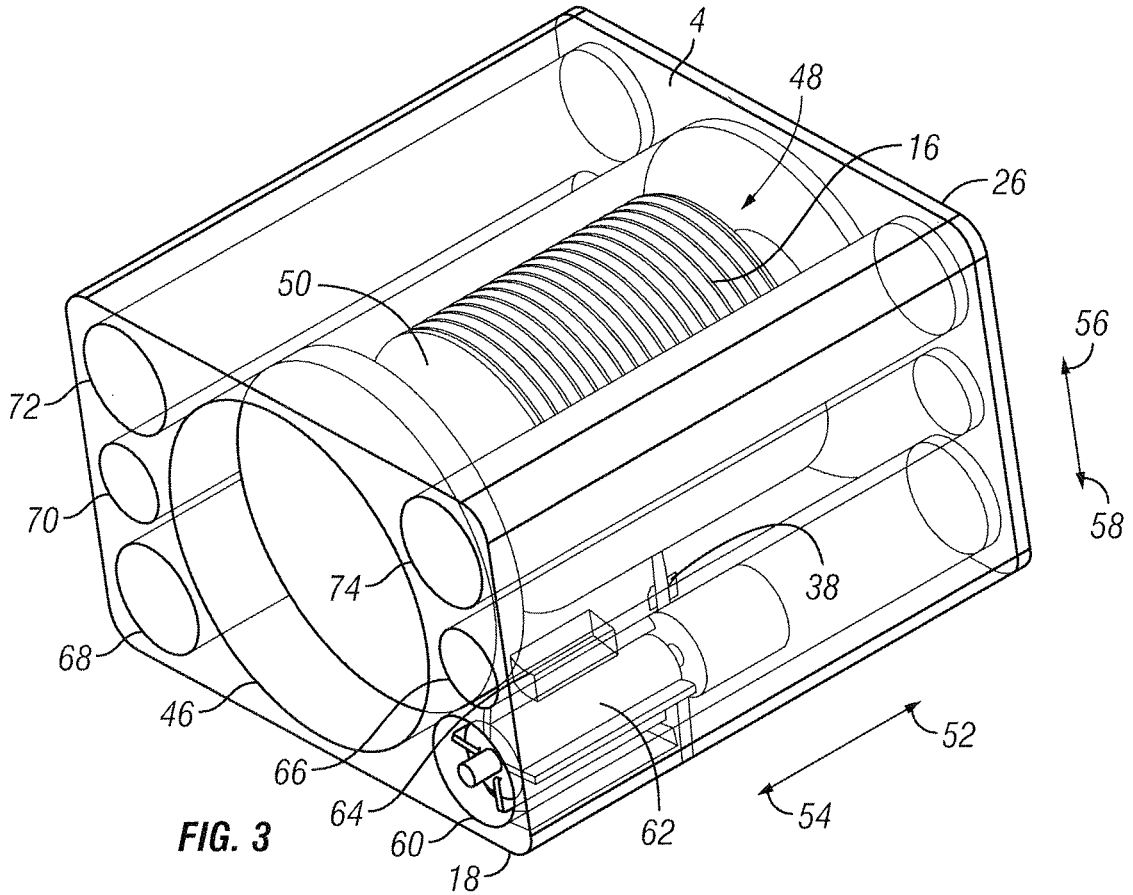
FIG. 3 is a side perspective transparent view of the housing portion of the electric powered pneumatic balancer of FIGS. 1 and 2.

A side perspective transparent view of housing 4 of electric powered pneumatic balancer 2 is shown in FIG. 3. This view depicts the interior structures and components inside housing 4. For instance, a bore 46 is disposed through housing 4 in size and shape to receive a conventional balancer mechanism 48. Such balancers, as previously discussed, are of the type disclosed in the foregoing patents incorporated herein by reference. For illustrative purposes, all the components that mechanically operate such air balancers may be included in air balancer mechanism 48 except the direct pressurized air power source. Instead, the remaining mechanisms in electric powered pneumatic balancer 2 provide balancer 48 inside housing 4 with the pressurized air needed to operate it.

As shown, cable 16 is wound on drum 50 such that when air is forced into bore 46, a piston or other like mechanism is moved by the compressed air in direction 52 to wind drum 50, thereby retracting cable 16 to lift a suspended object in direction 56. Conversely, reducing the fluid pressure from bore 46 in direction 54 causes drum 50 to rotate in the opposite direction, thereby unwinding or lowering cable 16 moving same in direction 58. Furthermore, cable 16 is to be disposed through opening 38 on underside 18 of housing 4.

A utility of housing 4 is that it holds more than simply the balancer mechanism. As shown herein, another illustrative bore 60 houses compressor assembly 62 in order to generate the pressurized air to power balancer mechanism 48. It will be appreciated by the skilled artisan upon reading this disclosure that compressor assembly 62 may be located in any number of locations in or on electric powered pneumatic balancer 2. The location as depicted herein is illustrative. Compressor assembly 62 is configured to supply pressurized air to fill other chambers in housing 4 so there is a sufficient supply of pressurized air to act on balancer mechanism 48 as needed. To that end, illustrative air passage 64 connects pressurized air produced by compressor assembly 62 in order to fill air chamber 66. As will be demonstrated further herein, chamber 66 may be in fluid communication with one or more of the other chambers 68, 70, 72, 74 which likewise store pressurized fluid. In other embodiments, one or more of such chambers may be used for alternative purposes, such as housing electronic controls to turn the compressor ON/OFF, or house a second compressor to generate more compressed air for higher duty cycle operations, for example. Furthermore, one or more of end caps such as 26 or 28 may be used to provide passage for the pressurized air to fill the other air chambers.

Figure 4:
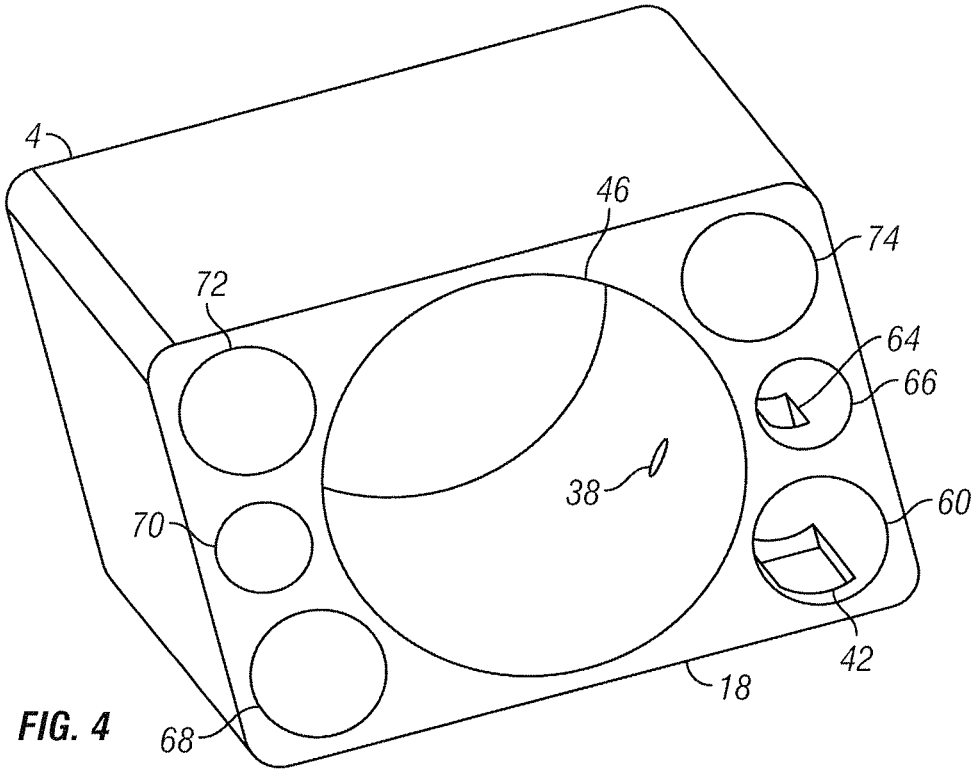
FIG. 4 is a front perspective view of the housing portion of the electric powered pneumatic balancer.

A perspective view of housing 4 is shown in FIG. 4, this view further depicts bore 60 along with chambers 66, 68, 70, 72, and 74. Air port 42 is shown disposed through underside 18 of housing 4 and into bore 60. Similarly, air passage 64 is shown disposed through housing 4 providing fluid communication between bore 60 and chamber 66. Bore 46 that receives balancer 48 is shown herein disposed through housing 4. Likewise, opening 38 is shown disposed through housing 4 to provide communication from bore 46 to the exterior of housing 4 (see, also, FIGS. 1 and 2). In an illustrative embodiment, housing 4 may be made from cast aluminum or extruded aluminum.

Figure 5:
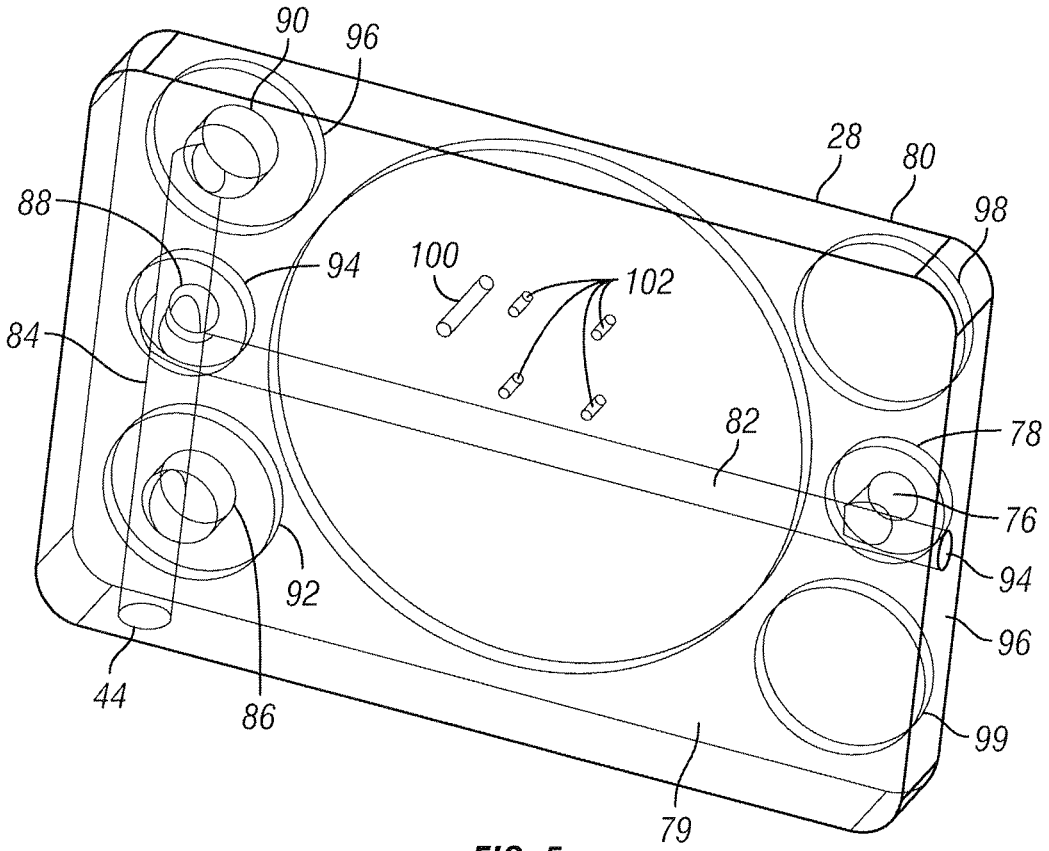
FIG. 5 is a forward-facing perspective transparent view of an end cap portion of the electric powered pneumatic balancer.

A forward-facing perspective transparent view of end cap 28 is shown in FIG. 5. This view demonstrates how air pressure generated by compressor 62 (see, FIG. 3) may be distributed to other air chambers 68, 70, and 72 from chamber 66 (which is in fluid communication with compressor 62 located in bore 60). Opening 76 is disposed through illustrative plug 78 extending from rear side 80 of end cap 28. Opening 76 provides fluid communication to passageway 82 located within the body of end cap 28 and leads to passageway 84 which is in fluid communication with openings 86, 88, and 90, which extend through plugs 92, 94, 96, respectively. Said openings 86, 88, and 90 also open to chambers 68, 70, and 72, respectively, to allow pressurized air generated by compressor 62 to fill these chambers. In this illustrative embodiment, plug 94 may be extended into passageway 82.

In an illustrative method of manufacturing, passageway 82 may be bore through the body of end cap 28 and sealed off at side 96 by plug 94. It is appreciated that other methods of forming said passageway may be employed where such plug is not needed. Additionally, plugs 78, 92, 94, and 96, as well as other plugs, 98 and 99 may be used to assist sealing the open ends of their corresponding chambers. Also in this illustrative embodiment, some chambers such as chamber 74 may be used for other purposes such as housing electronic components, etc. Illustratively, to increase the storage capacity of electric powered pneumatic balancer 2, passageway 82 may be modified to extend an additional passageway up to plug 98 in order to deposit more pressurized air in chamber 74. It will be appreciated by the skilled artisan upon reading this disclosure that the passageways and chambers used for either pressurized air or other purposes may vary depending upon the needs and application for electric powered pneumatic balancer 2.

In the illustrative embodiment, air port 44 is the opening to exterior of end cap 28 for passageway 84. In addition to pressurizing the chambers, the air pressure needs to be extended to controller 36 (see FIG. 1) in order to ensure the air pressure is sufficiently (albeit selectively) distributed to balancer 48. Accordingly, supply tube 34, (as shown in FIG. 2) is disposed into air port 44 so that pressurized air from passageway 84 may be disposed therein. By this means, compressor 62 may generate pressurized air and distribute that pressurized air throughout chambers 66, 68, 70, and 72, as well as through supply tube 34. With controller 36 activated to raise cable 16, the pressurized air is allowed to enter supply tube 32, which goes into controls manifold 30 and bore 46 to exert force on balancer 48. To that end, end cap 28 further includes illustrative fastener bores 102 configured to attach controls manifold 30 onto end cap 28 illustratively using bolts. In this illustrative embodiment, however, a supply bore 100 is disposed through end cap 28 from front side 79 to rear side 80. As such, pressurized fluid allowed to flow through supply tube 32 from controller 36 is dispensed through supply bore 100 and into bore 46 to exert a force on balancer 48, thereby moving same and retracting cable 16. When unwinding cable 16, controller allows air from bore 46 to escape through supply bore 100 and out of electric powered pneumatic balancer 2.

Figure 6:
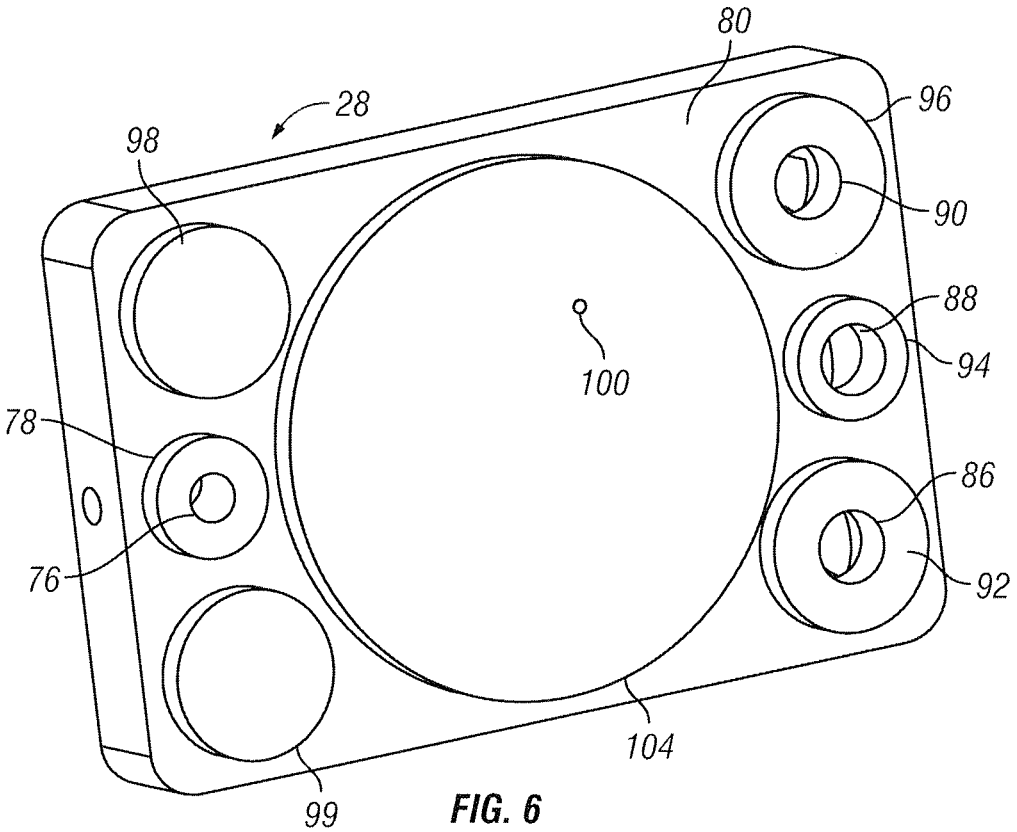
FIG. 6 is a rear-facing perspective view of the end cap shown in FIG. 5.

A rear-facing perspective view of end cap 28 shown in FIG. 6. This view depicts plugs 99, 78, 92, 94, 96, and 98. Also shown in this view is plug 104 which, like the other plugs, is configured to assist sealing bore 46 that houses balancer 48. An end of supply bore 100 is also shown disposed through plug 104. This view also shows openings 76, 86, 88, and 90, all being in fluid communication with each other to distribute pressurized fluid throughout housing 4 from compressor 62.

Figure 7:
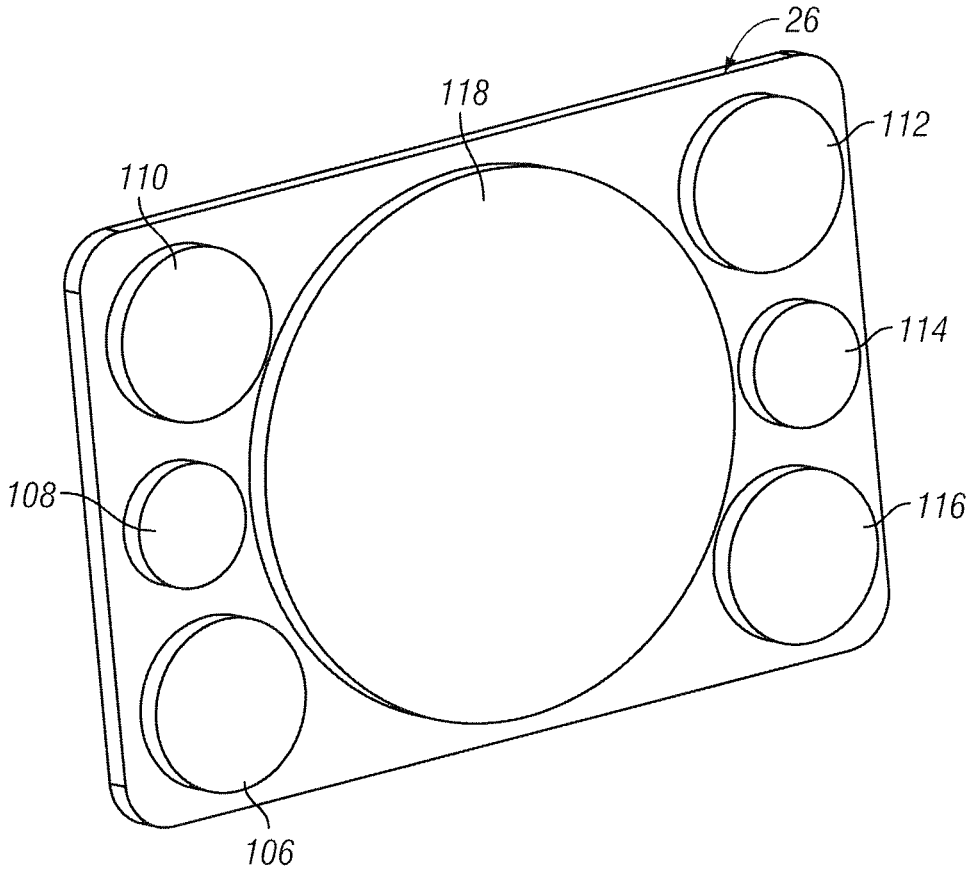
FIG. 7 is a rear-facing perspective view of another end cap of the electric power pneumatic balancer.

In similar vein, a rear facing perspective view of end cap 26 is shown in FIG. 7. This view includes plugs 106, 108, 110, 112, 114, 116, and 118. Such plugs are configured to assist sealing corresponding bores and chambers 68, 70, 72, 74, 66, 60, and 46, respectively, in housing 4 (see, also, FIG. 4). Although not shown, end cap 26 may include a bore or other means to allow passage of power cord 24 to extend there through for plugging into a power outlet. As discussed, power cord 24 may be disposed through other means or locations of electric powered pneumatic balancer 2 in order to plug into a power outlet. In a further embodiment, compressor 62 may be battery employed so that no external power source is needed during operation of electric powered pneumatic balancer 2.

Figure 8:
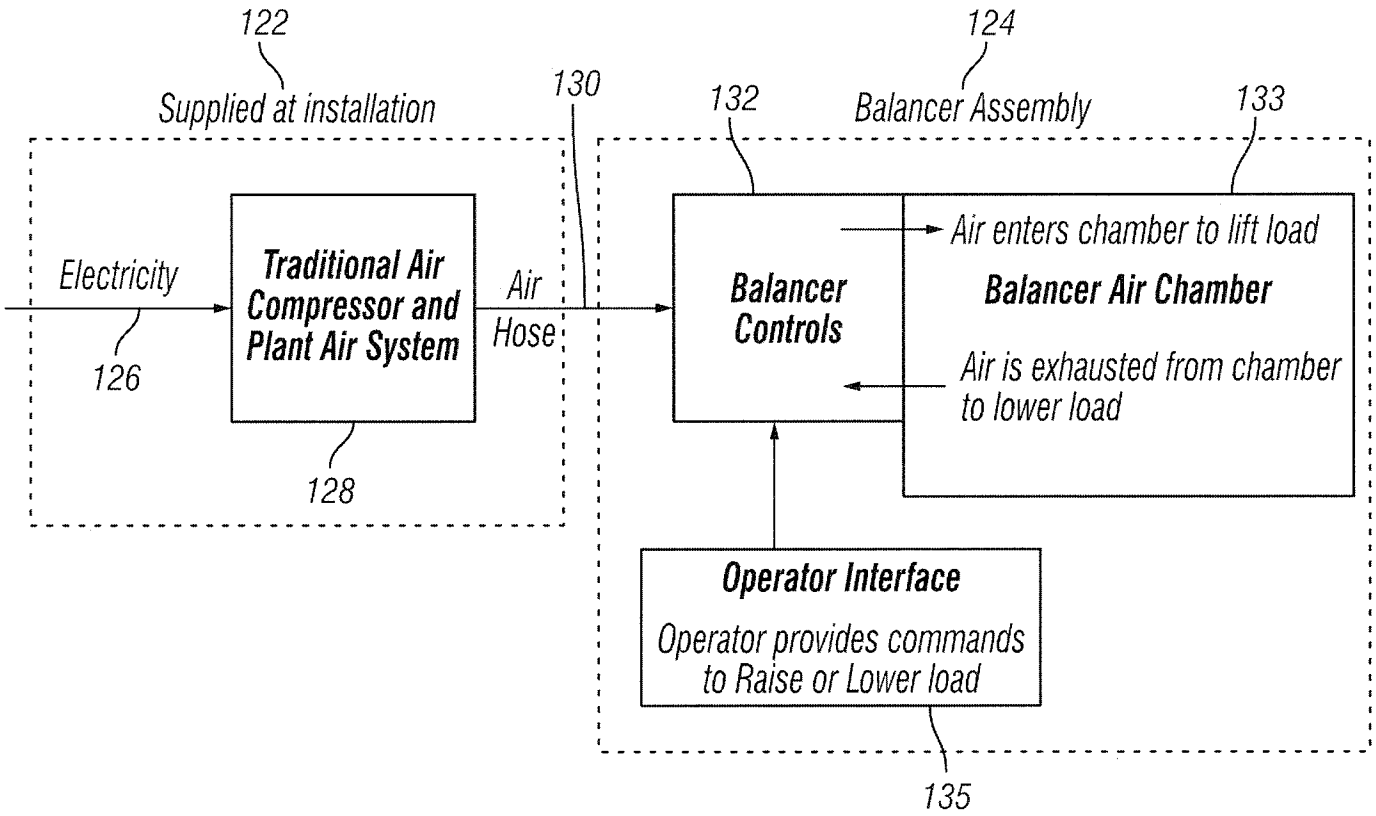
(Prior Art) FIG. 8
FIG. 8 is a diagram of a PRIOR ART air balancer system.
Figure 9:
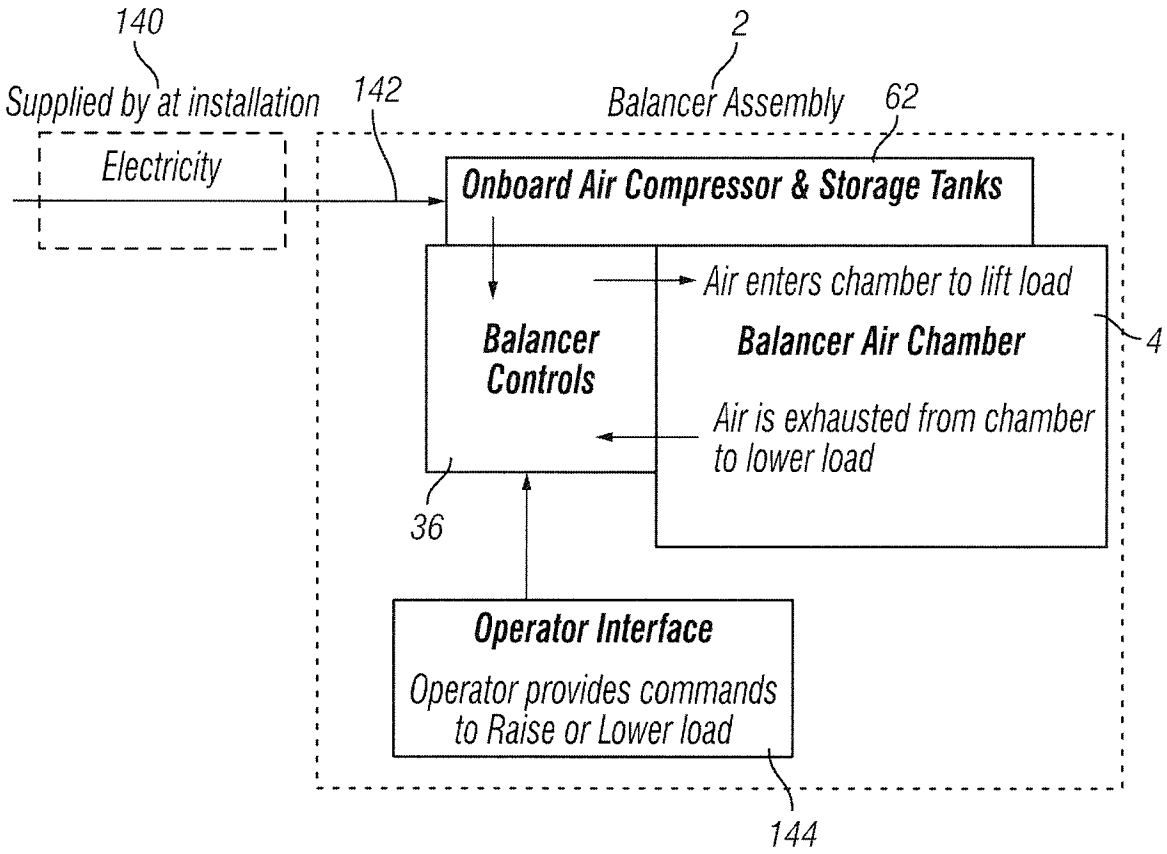
FIG. 9 is a diagram of an electric powered pneumatic balancer system according to an illustrative embodiment of the present disclosure.

Distinguishing utilities and features of electric powered pneumatic balancer 2 from the prior art is demonstrated when comparing the diagram of PRIOR ART FIG. 8 with the diagram of FIG. 9. The diagram in PRIOR ART FIG. 8 depicts facilities supplied at installation at 122 and PRIOR ART balancer assembly 124. As shown, both electricity and compressed air 126 and 128, respectively, are required to be supplied at installation 122. An air hose 130 is fluidly coupled to balancer controls 132 of PRIOR ART which is coupled to balance air chamber 133 of balancer assembly 124 and operated through operator interface 135.

In contrast, facilities to be supplied at installation 140 in the diagram of FIG. 9 are limited to only an electricity source. Such electricity is supplied to electric powered pneumatic balancer assembly 2 at 142 (which may be a power cord, such as power cord 24 shown in FIGS. 1 and 2). There is no external compressed air supply required to supply to the balancer. This allows an expanded utility of electric powered pneumatic air balancer 2 because many locations, such as in vehicles, office, or warehouse settings, do not typically have a dedicated compressed air supply. But all of these facilities do have a power source such as conventional power outlets. Once power is supplied at 142 to the onboard air compressor, such as compressor 62 (see, also, FIG. 3), balancer controls 36 may be operated by operator 144 to direct the pressurized air into housing 4 to lift the load connected to cable 16. And, as previously discussed, controller 36 may be activated to release or exhaust air from bore 46 to extend cable 16 and lower the load.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

The invention claimed is:

1. An electric powered pneumatic balancer comprising:
- a housing that includes a first cavity structured to store pressurized air;
- an air balancer located in the housing and spaced apart from the first cavity;
- a compressor located in the housing and spaced apart from the first cavity;
- wherein the housing includes an opening to receive air to the compressor;
- wherein the compressor generates compressed air;
- wherein the compressor is in fluid communication with the balancer;
- wherein the air balancer operates in response to receipt of the pressurized air from the compressor; and
- an electrical power supply that is in electrical communication with the compressor to power the compressor to generate the pressurized air.

2. The electric powered pneumatic balancer of claim 1, wherein the housing further includes a cavity that stores pressurized air to deliver to the air balancer.

3. The electric powered pneumatic balancer of claim 1, wherein the air balancer only receives compressed air from the compressor and does not receive compressed air from a source separate from the electric powered pneumatic balancer.

4. An electric powered pneumatic balancer comprising:
- a housing that includes a first cavity;
- an air balancer located in the housing and spaced apart from the first cavity of the housing;
- a compressor located in the housing and spaced apart from the first cavity of the housing;
- wherein the housing includes an opening to receive air to the compressor;
- wherein the compressor generates compressed air;
- wherein the first cavity is in fluid communication with the compressor in the housing and stores pressurized air;
- wherein the air balancer operates in response to receipt of the pressurized air that moves from the compressor in the housing and the first cavity; and
- an electrical power supply in electrical communication with the compressor to power the compressor to generate the pressurized air.

5. The electric powered pneumatic balancer of claim 4, further comprising a first supply tube in fluid communication with the first cavity, a controller fluidly coupled to the first supply hose to receive the pressurized air from the first cavity, a second supply tube that is in fluid communication with the controller and the air balancer; and through the first supply tube, controller, and second supply tube compressed air is selectively supplied to the air balancer.

6. The electric powered pneumatic balancer of claim 4, wherein the air balancer only receives compressed air from the compressor and does not receive compressed air from a source separate from the electric powered pneumatic balancer.

7. The electric powered pneumatic balancer of claim 4, wherein the housing is open on each of its first and second ends, and further comprises a first end cap that covers the first end of the housing, and wherein a first passageway is disposed within the first end cap in fluid communication with at least the first cavity of the housing and the first supply tube.

8. The electric powered pneumatic balancer of claim 7, wherein the first endcap includes a seal, wherein the seal seals the housing and the first cavity.

9. The electric powered pneumatic balancer of claim 4, further comprising an electrical cord that supplies electric power to the compressor.

10. The electric powered pneumatic balancer of claim 4, further comprising a battery that supplies electric power to the compressor.

11. An electric powered pneumatic balancer comprising:
- a housing that includes a first cavity, a second cavity spaced apart from the first cavity, and a third cavity spaced apart from the first and second cavities;
- an air balancer located in the first cavity of the housing;
- a compressor located in the second cavity of the housing;
- wherein the housing includes an opening to receive air to the compressor;
- wherein the third cavity is in fluid communication with the compressor in the second cavity and stores pressurized air produced by the compressor;
- a first supply tube in fluid communication with the third cavity;
- a controller fluidly coupled to the first supply tube to receive the pressurized air from the third cavity;
- a second supply tube that is in fluid communication with the controller and the air balancer;
- wherein the air balancer operates in response to the pressurized fluid that moves from the compressor and stored in the third cavity, through the first supply tube, controller, and second supply tube; and
- an electrical power supply in electrical communication with the compressor to power the compressor to generate the pressurized air.

12. The electric powered pneumatic balancer of claim 11, wherein the air balancer only receives compressed air from the compressor and does not receive compressed air from a source separate from the electric powered pneumatic balancer.

13. The electric powered pneumatic balancer of claim 12, further comprising an electrical cord that supplies electric power to the compressor.

14. The electric powered pneumatic balancer of claim 12, further comprising a battery that supplies electric power to the compressor.

15. The electric powered pneumatic balancer of claim 11, wherein the housing further includes fourth and fifth cavities that are spaced apart from each other and the first, second, and third cavities, but are in fluid communication with each other and the first, second, and third cavities.

16. The electric powered pneumatic balancer of claim 15, wherein the housing is open on each of its first and second ends.

17. The electric powered pneumatic balancer of claim 16, further comprising a first end cap that covers the first end of the housing, and wherein a first passageway is disposed within the first end cap in fluid communication with at least the third cavity of the housing and the first supply tube.

18. The electric powered pneumatic balancer of claim 16, further comprising a first end cap that covers the first end of the housing, and wherein a first passageway is disposed within the first end cap in fluid communication with at least the compressor and the first supply tube.

19. The electric powered pneumatic balancer of claim 16, wherein the housing further includes fourth and fifth cavities that are spaced apart from each other and the first, second, and third cavities, but are in fluid communication with each other and the first, second, and third cavities, wherein the housing is open on each of its first and second ends, wherein the electric powered pneumatic balancer further comprises a first end cap that covers the first end of the housing, and wherein a first passageway is disposed within the first end cap in fluid communication with the third, fourth, and fifth cavities and the first supply tube.

20. The electric powered pneumatic balancer of claim 16, wherein the first endcap includes a plurality of seals, wherein each of the plurality of seals seal the first, second, and third cavities, respectively.

* * * * *